US010928040B2

(12) United States Patent
Yeh

(10) Patent No.: US 10,928,040 B2
(45) Date of Patent: Feb. 23, 2021

(54) LED LAMP WITH ADJUSTABLE ILLUMINATING RANGE

(71) Applicant: ZHONGSHAN LITES "R" US CO., LTD., Zhongshan (CN)

(72) Inventor: Lu-Sung Yeh, Zhongshan (CN)

(73) Assignee: ZHONGSHAN LITES "R" US CO., LTD

( * ) Notice: Subject to any disclaimer, the term of this patent is extended or adjusted under 35 U.S.C. 154(b) by 0 days.

(21) Appl. No.: 16/551,820

(22) Filed: Aug. 27, 2019

(65) Prior Publication Data

US 2020/0173632 A1 Jun. 4, 2020

(30) Foreign Application Priority Data

Dec. 4, 2018 (CN) ..... 201822030506.3

(51) Int. Cl.

| | |
|---|---|
| ***F21V 14/08*** | (2006.01) |
| ***F21V 19/00*** | (2006.01) |
| *F21V 14/04* | (2006.01) |
| *F21V 11/18* | (2006.01) |
| *F21Y 115/10* | (2016.01) |
| *F21Y 103/00* | (2016.01) |
| *F21V 14/00* | (2018.01) |
| *F21V 21/30* | (2006.01) |
| *F21V 11/16* | (2006.01) |

(52) U.S. Cl.

CPC ..... *F21V 14/08* (2013.01); *F21V 19/001* (2013.01); *F21V 11/16* (2013.01); *F21V 11/18* (2013.01); *F21V 11/183* (2013.01); *F21V 14/00* (2013.01); *F21V 14/04* (2013.01); *F21V 21/30* (2013.01); *F21Y 2103/00* (2013.01); *F21Y 2115/10* (2016.08)

(58) Field of Classification Search

CPC ..... F21V 11/18; F21V 11/183; F21V 14/00; F21V 14/04; F21V 14/08; F21V 14/085; F21V 7/16; F21V 19/001; F21V 21/30; F21Y 2103/00; F21Y 2115/10

See application file for complete search history.

(56) References Cited

U.S. PATENT DOCUMENTS 4,043,662 A * 8/1977 Garfall ..... G03B 27/542 355/71
4,322,779 A * 3/1982 Bohme ..... F21V 7/18 362/17
4,701,832 A * 10/1987 Lasker ..... F21S 8/086 362/281

(Continued)

*Primary Examiner* — Zheng Song
(74) *Attorney, Agent, or Firm* — Dilworth IP, LLC

(57) ABSTRACT

An LED lamp with an adjustable illuminating range is provided, including a lamp body. The lamp body includes a base, a lamp housing arranged on the base, and a light source assembly arranged inside the lamp housing. At least one side of the lamp housing includes an open structure allowing light from the light source assembly to emit. An adjusting mechanism is configured inside the lamp housing to adjust the illuminating range of the light emitted from the light source assembly. An emergence angle of the light source assembly or a size of the opening structure can be adjusted by the adjusting mechanism, thereby adjusting the illuminating range or an illuminating area of emitted light and meeting different user demands.

7 Claims, 4 Drawing Sheets

(56) References Cited

U.S. PATENT DOCUMENTS

| | | | | | |
|---|---|---|---|---|---|
| 4,814,958 | A * | 3/1989 | Hsieh | F21V 11/02 | 362/147 |
| 5,418,694 | A * | 5/1995 | Weigert | F21V 11/18 | 362/18 |
| 6,382,817 | B1 * | 5/2002 | Chelf | F21S 8/031 | 362/217.07 |
| 6,462,775 | B1 * | 10/2002 | Loyd | F21V 33/0052 | 348/143 |
| 6,893,317 | B1 * | 5/2005 | Vlodek | A63H 33/22 | 40/377 |
| 7,677,764 | B2 * | 3/2010 | Lin | F21V 7/10 | 362/217.05 |
| 2001/0012205 | A1 * | 8/2001 | Lassovsky | F21S 8/026 | 362/282 |
| 2007/0115655 | A1 * | 5/2007 | Kaminski | B63B 45/06 | 362/227 |
| 2009/0091914 | A1 * | 4/2009 | Nobayashi | B60Q 1/2611 | 362/35 |
| 2009/0303710 | A1 * | 12/2009 | Lin | F21V 7/10 | 362/232 |
| 2018/0066829 | A1 * | 3/2018 | Zhan | F21V 13/02 | |
| 2018/0128453 | A1 * | 5/2018 | Yuan | F21K 9/235 | |

* cited by examiner

LED LAMP WITH ADJUSTABLE ILLUMINATING RANGE

TECHNICAL FIELD

The present application relates to an LED lamp, and in particular, to an LED lamp with an adjustable illuminating range.

BACKGROUND

LED lamps, such as wall lamps, spotlights and so on, are used for illuminating a designated area. In order to achieve the decorative and illuminating effects of the area, the emergence angle of the LED lamp is usually defined, so as to control the illuminating area and achieve a specific decorative effect. But in practical use, it may be necessary to adjust the illuminated objects or areas, therefore the LED lamp in the prior art cannot achieve the best decorative and illuminating effect, and it is usually necessary to replace the lamps or the light groups. Such an operation is troublesome, and the implementation cost is high.

SUMMARY

In order to overcome the deficiencies of the prior art, the present application provides an LED lamp with an adjustable illuminating range.

The technical solutions of the present application to solve the technical problems are as follows.

An LED lamp with an adjustable illuminating range is provided, including a lamp body. The lamp body includes a base, a lamp housing arranged on the base, and a light source assembly arranged inside the lamp housing. At least one side of the lamp housing is an open structure allowing light from the light source assembly to emit. An adjusting mechanism is configured inside the lamp housing to adjust the illuminating range of the light emitted from the light source assembly.

The adjusting mechanism includes at least one light distribution board rotatably arranged inside the lamp housing.

The at least one light distribution board includes two light distribution boards arranged symmetrically on two sides of the light source assembly.

The adjusting mechanism is provided with a first damping assembly configured to provide a rotation damping force for the light distribution board.

The first damping assembly is a rubber gasket arranged at a rotating joint of the light distribution board.

A mounting plate is arranged at a bottom of the lamp housing, an upper end of the light distribution board is rotatably arranged at a top of the lamp housing, and a lower end of the light distribution board is rotatably arranged on the mounting plate.

Each of two sides of the lamp housing is an open structure, two light source assemblies are configured to respectively correspond to two open structures, and two adjusting mechanisms are configured to respectively correspond to the two light source assemblies.

The lamp housing is rotatably arranged on the base.

A second damping assembly is arranged between the lamp housing and the base, and configured to provide a rotation damping force for the lamp housing.

The second damping assembly is a rubber ring arranged at a junction of the lamp housing and the base.

The beneficial effects of the present application are as follows. The LED lamp with an adjustable illuminating range includes a lamp body, the lamp body includes a base, a lamp housing arranged on the base, and a light source assembly arranged inside the lamp housing, at least one side of the lamp housing is an open structure allowing light from the light source assembly to emit, and an adjusting mechanism is configured inside the lamp housing to adjust the illuminating range of the light emitted from the light source assembly, so that the emergence angle of the light source assembly or the size of the opening structure can be adjusted by the adjusting mechanism, thereby adjusting the illuminating range or the illuminating area of the emitted light and meeting different user demands.

BRIEF DESCRIPTION OF THE DRAWINGS

The present application will be further described by reference to the following description of exemplary embodiments taken in conjunction with the accompanying drawings.

DETAILED DESCRIPTION OF THE PREFERRED EMBODIMENTS

Figure 1:
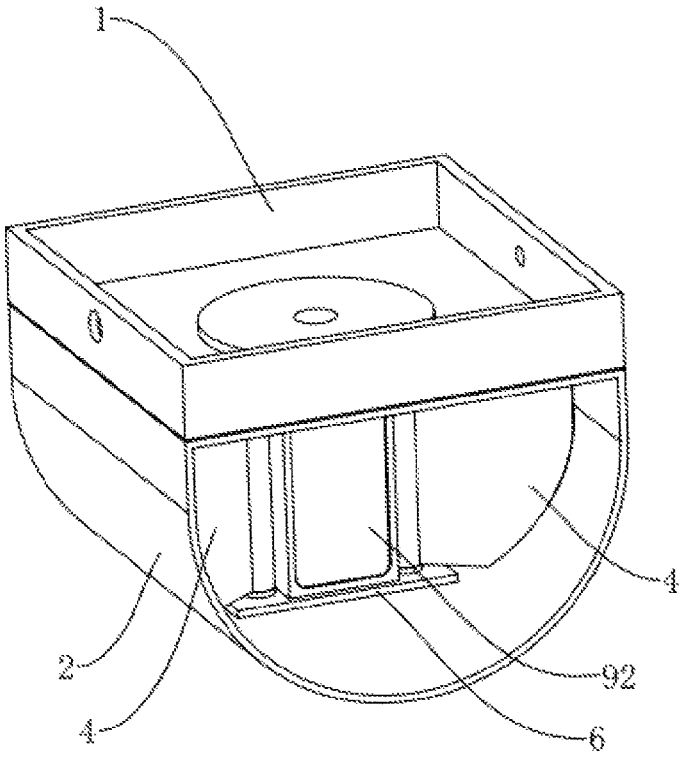
FIG. 1 is a structural schematic diagram illustrating a first embodiment of the present application.
Figure 2:
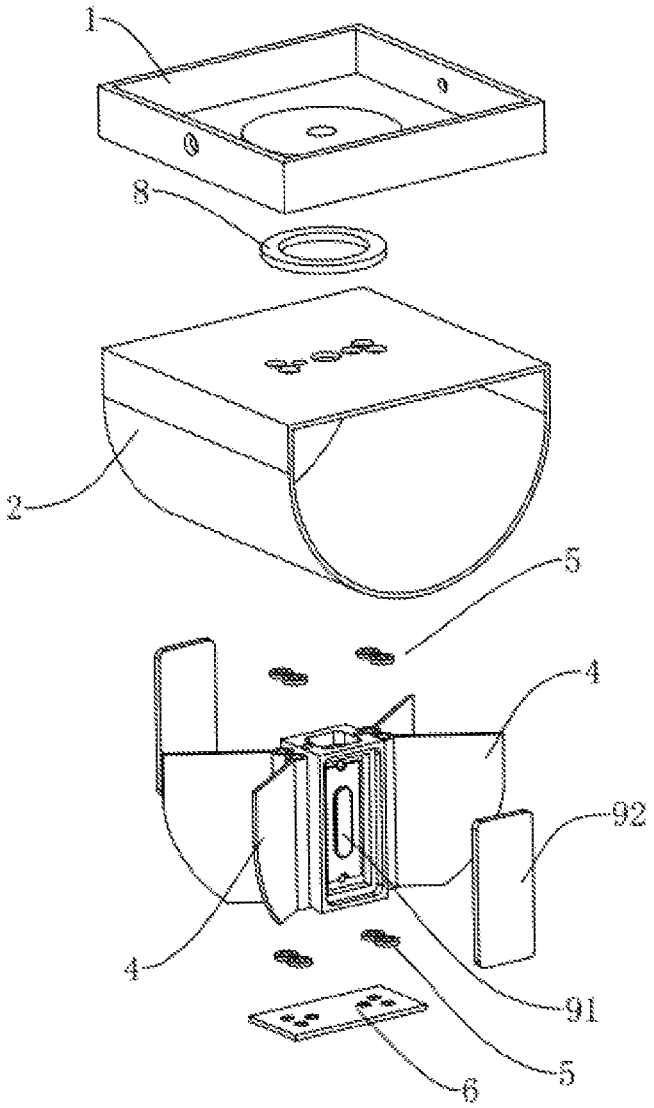
FIG. 2 is an exploded schematic diagram illustrating the first embodiment of the present application.

FIG. 1 is a structural schematic view of the first embodiment of the present application, and FIG. 2 is an exploded schematic view of the first embodiment of the present application. As shown in FIGS. 1 and 2, an LED lamp with an adjustable illuminating range includes a lamp body. The lamp body includes a base 1, a lamp housing 2 arranged on the base 1, and a light source assembly arranged inside the lamp housing 2. At least one side of the lamp housing 2 is an open structure allowing the light of the light source assembly to emit. An adjusting mechanism is configured inside the lamp housing 2 to adjust an illuminating range of the light emitted from the light source assembly. The emergence angle of the light source assembly or the size of the opening structure can be adjusted by the adjusting mechanism, thereby adjusting the illuminating range or the illuminating area of the emitted light and meeting different user demands.

Preferably, the adjusting mechanism includes at least one light distribution board 4 which is rotatably arranged inside the lamp housing 2. The emergence angle of the light source assembly can be adjusted by rotating the light distribution board 4, to achieve the goal of adjusting the illuminating range. Of course, a light-shielding structure such as a baffle can be provided at the opening structure, thereby achieving the effect of light distribution.

Preferably, two light distribution boards 4 are arranged symmetrically on two sides of the light source assembly. In this embodiment, the two light distribution plates 4 are independent rotatable structures, and either light distribution plate 4 can be adjusted independently, so as to meet different light distribution demands. Of course, the two light distribution plates 4 can also be adjusted synchronously by a linkage such as a gear or a synchronous belt, so as to ensure the symmetry of the illuminating area.

In this embodiment, each of two sides of the lamp housing 2 is an open structure. Two light source assemblies are configured to respectively correspond to two open structures. Two adjusting mechanisms are configured to respectively correspond to the two light source assemblies. That is to say, the light is emitted at both sides of the lamp housing 2, and the illuminating ranges of the emitted light at both sides of the lamp housing 2 are both adjustable, which is convenient for double-sided illumination. Especially when it is used as a wall panel lamp, the lamp has better decorative and illuminating effects on the wall body.

Preferably, in this embodiment, a light source mounting seat 7 is configured inside the lamp housing 2 to mount the light source assembly. The light distribution boards 4 are arranged on both sides of the light source mounting seat 7. The light source assembly includes an LED light source 91 arranged on the light source mounting seat 7, and a light transmitting plate 92 arranged on the light source mounting base 7 and corresponding to the LED light source 91. Of course, in a specific implementation, the light source assembly can be an integrated light source such as COB, which will not be described in detail herein.

Preferably, as shown in the drawings, a mounting plate 6 is arranged at a bottom of the lamp housing 2. The upper end of the light distribution board 4 is rotatably arranged at the top of the lamp housing 2 through a rotating structure, and the lower end of the light distribution board 4 is rotatably arranged on the mounting plate 6 through a rotating structure. The mounting plate 6 is configured to prevent the rotating structures, such as screws, shaft pins, pins, etc., from being exposed from the bottom (i.e., the outer side) of the lamp housing, so as to ensure the appearance effects. Of course, a rotating shaft can also be directly arranged at the bottom of the lamp housing 2, which will not be described in detail herein.

Preferably, the adjusting mechanism is provided with a first damping assembly capable of providing a rotation damping force for the light distribution board 4, so as to conveniently position the light distribution board 4, thereby enabling the lamp to maintain the adjusted illuminating range. As shown in the drawings, the first damping assembly is a rubber gasket 5 arranged at a rotating joint of the light distribution board 4. When assembled, the rubber gasket 5 is pressed and deformed to generate a larger friction force, thereby realizing the effect of positioning by damping. Of course, in a specific implementation, the first damping assembly can also be a friction plate or the like, which will not be described in detail herein.

Further, the lamp housing 2 is rotatably arranged on the base 1 through the rotating structures, such as screws, shaft pins, pins, etc., so as to adjust the opening direction of the lamp housing 2, thereby adjusting the illuminating direction and meeting different user demands.

Preferably, a second damping assembly, which is capable of providing a rotation damping force for the lamp housing 2, is arranged between the lamp housing 2 and the base 1, so as to position the lamp housing 2, thereby enabling the lamp to maintain the adjusted illuminating range. In this embodiment, the second damping assembly is a rubber ring 8 arranged at the junction of the lamp housing 2 and the base 1. When assembled, the rubber ring 8 is pressed and deformed to generate a larger friction force, thereby achieving the effect of positioning by damping. Of course, in a specific implementation, the second damping assembly can also be a friction plate or the like, which will not be described in detail herein.

Figure 3:
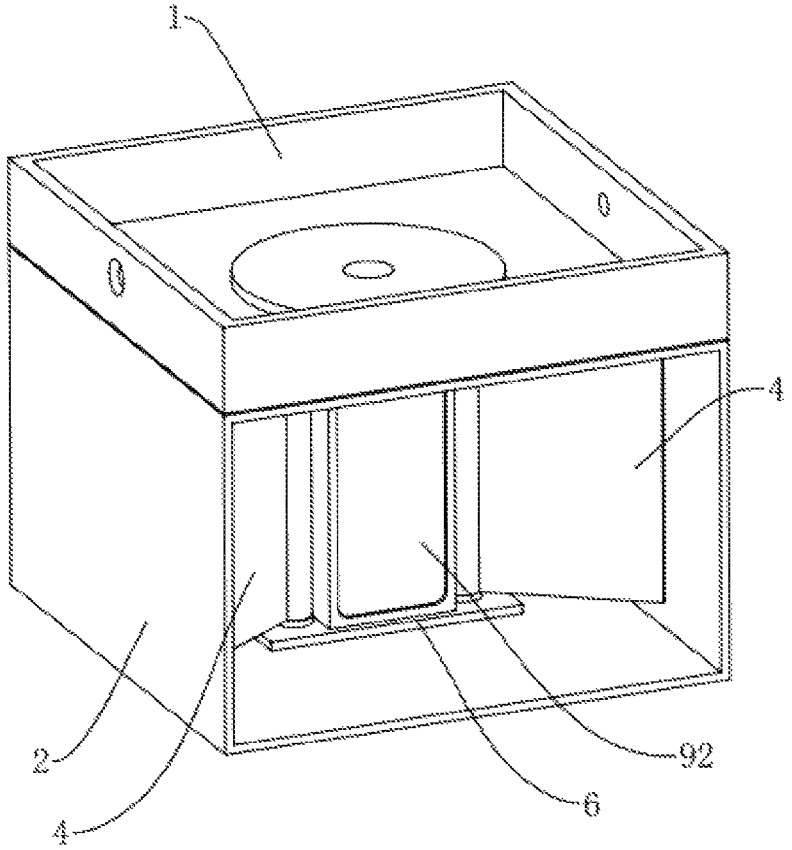
FIG. 3 is a structural schematic diagram illustrating a second embodiment of the present application.
Figure 4:
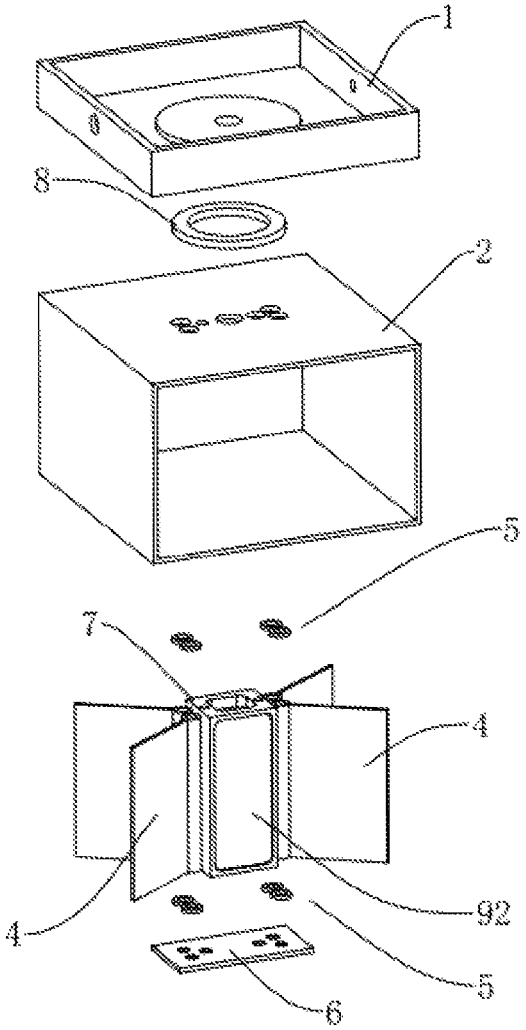
FIG. 4 is an exploded schematic diagram illustrating the second embodiment of the present application.

In this embodiment, the lamp housing 2 is in a semicircular-cross-sectioned structure, and the light distribution board 4 is in a fan-shaped structure matching an inner wall of the semicircular-cross-sectioned lamp housing 2, thereby ensuring a larger adjustable angle and ensuring the compactness of fit. Of course, in a specific implementation, the lamp housing 2 can also be configured to be of other shapes, such as a trapezoidal shape, or in a square structure shown in FIG. 3 and FIG. 4. FIG. 3 is a structural schematic diagram illustrating a second embodiment of the present application. FIG. 4 is an exploded schematic diagram illustrating the second embodiment of the present application. As shown in FIGS. 3 and 4, in this embodiment, the lamp housing 2 is in a square structure, and the light distribution board 4 is in a square structure matching the inner wall of the square shaped lamp housing 2.

What described above are preferable embodiments of the present invention. Of course, the present invention can also adopt a different form from the above-described embodiments. For those skilled in the art, equivalent transformation or corresponding modifications made without departing from the spirits of the present invention are within the scope of the present invention.

What is claimed is:

1. An LED lamp with an adjustable illuminating range, comprising a lamp body, wherein the lamp body includes a base, a lamp housing rotatably arranged on the base, and a light source assembly arranged inside the lamp housing, at least one side of the lamp housing is an open structure allowing light from the light source assembly to emit, a bottom of the lamp housing is opposite to the base, and an adjusting mechanism is configured inside the lamp housing to adjust the illuminating range of the light emitted from the light source assembly, the adjusting mechanism including at least one light distribution board rotatably arranged inside the lamp housing;

wherein a mounting plate is arranged at the bottom of the lamp housing, an upper end of the light distribution board is rotatably arranged at a top of the lamp housing, and a lower end of the light distribution board is rotatably arranged on the mounting plate.

2. The LED lamp according to claim 1, wherein the at least one light distribution board includes two light distribution boards arranged symmetrically on two sides of the light source assembly.

3. The LED lamp according to claim 1, wherein the adjusting mechanism is provided with a first damping assembly configured to provide a rotation damping force for the at least one light distribution board.

4. The LED lamp according to claim 3, wherein the damping assembly is a rubber gasket arranged at a rotating joint of the at least one light distribution board.

5. The LED lamp according to claim 1, wherein each of two sides of the lamp housing is an open structure, two light source assemblies are configured to respectively correspond to two open structures, and two adjusting mechanisms are configured to respectively correspond to the two light source assemblies.

6. The LED lamp according to claim 1, wherein a limitation assembly is arranged between the lamp housing and the base, and configured to provide a rotation damping force for the lamp housing.

7. The LED lamp according to claim 6, wherein the limitation assembly is a rubber ring arranged at a junction of the lamp housing and the base.

* * * * *